US007127854B2

(12) United States Patent
Hedrick

(10) Patent No.: US 7,127,854 B2
(45) Date of Patent: Oct. 31, 2006

(54) BULK MATERIAL STORAGE FACILITIES WITH ACCESS CHASES AND/OR INTERNAL FILLING STRUCTURES

(76) Inventor: Thomas W. Hedrick, 102 Larkspur, Sikeston, MO (US) 63801

( * ) Notice: Subject to any disclaimer, the term of this patent is extended or adjusted under 35 U.S.C. 154(b) by 221 days.

(21) Appl. No.: 10/366,495

(22) Filed: Feb. 13, 2003

(65) Prior Publication Data

US 2004/0159056 A1 Aug. 19, 2004

(51) Int. Cl.
*B65G 65/42* (2006.01)
*E04H 7/00* (2006.01)

(52) U.S. Cl. ..... 52/192; 52/195

(58) Field of Classification Search ..... 52/20, 52/21, 192, 195, 245, 309.12, 309.17, 197
See application file for complete search history.

(56) References Cited

U.S. PATENT DOCUMENTS 1,050,022 A * 1/1913 Hindmarsh ..... 52/182
1,050,953 A * 1/1913 Kint ..... 52/195
1,758,662 A * 5/1930 Heath ..... 52/197
2,500,043 A 3/1950 Radtke
2,801,137 A * 7/1957 Clay ..... 414/321
3,073,018 A * 1/1963 Gauthron ..... 52/247
3,363,785 A 1/1968 Kucera
3,513,995 A 5/1970 Stroker
3,526,328 A 9/1970 Garrett et al.
3,655,245 A 4/1972 Schumacher
3,847,289 A 11/1974 Fischer
3,953,629 A * 4/1976 Wesch ..... 428/324
3,968,998 A 7/1976 Wolf
3,977,541 A 8/1976 Watson
3,982,640 A 9/1976 Nauta
4,038,795 A * 8/1977 Abrams ..... 52/169.7
4,170,433 A 10/1979 Haahjem
4,324,074 A 4/1982 South et al.
4,373,623 A 2/1983 Bruecker
4,412,561 A * 11/1983 Sakaguchi et al. ..... 138/174
4,450,873 A * 5/1984 Sadler et al. ..... 138/174
4,462,744 A 7/1984 Rasilainen et al.
4,465,409 A 8/1984 Buschbom et al.
4,479,334 A * 10/1984 Goode ..... 52/197
4,616,969 A 10/1986 Haahjem
4,645,403 A 2/1987 DeWit
4,655,666 A 4/1987 Cantenot
4,721,425 A 1/1988 Strocker
4,773,808 A 9/1988 Fischer et al.
4,775,278 A 10/1988 Fischer et al.
4,806,058 A 2/1989 Galichowski et al.
4,885,880 A * 12/1989 Sudrabin et al. ..... 52/169.6
5,098,247 A 3/1992 Campbell
5,112,180 A 5/1992 Hough
5,180,272 A 1/1993 Campbell
5,241,797 A * 9/1993 Cliff ..... 52/192
5,449,263 A 9/1995 Campbell et al.
5,944,168 A 8/1999 Campbell et al.

(Continued)

*Primary Examiner*—Peter R. Brown
(74) *Attorney, Agent, or Firm*—Workman Nydegger

(57) ABSTRACT

A storage facility includes a storage structure having a floor and a boundary wall upwardly extending therefrom, the floor and boundary wall bounding a chamber adapted to receive bulk material. A tubular chase bounds a passageway and is at least partially disposed and upwardly extends within the chamber of the storage structure. A transfer pipe includes a raised section disposed and upwardly extending within the chamber. The transfer pipe terminates at an outlet port disposed in an upper portion of the chamber. A pump is coupled with the transfer pipe for conveying bulk material through the transfer pipe and into the chamber.

27 Claims, 5 Drawing Sheets

U.S. PATENT DOCUMENTS 5,967,729 A 10/1999 Foes
6,095,742 A 8/2000 Campbell
6,203,261 B1 3/2001 South et al.

* cited by examiner

BULK MATERIAL STORAGE FACILITIES WITH ACCESS CHASES AND/OR INTERNAL FILLING STRUCTURES

BACKGROUND OF THE INVENTION

1. The Field of the Invention

The present invention relates to bulk material storage facilities. More specifically, the present invention relates to bulk material storage facilities having internal access chases and/or internal filling structures. The present invention also relates to methods of construction for same.

2. The Relevant Technology

Bulk materials, such as grains, legumes, salt, cement, and other granulated or powdered flowable materials, have historically been stored in large storage facilities prior to shipment for end use. A typical storage facility includes a large silo having an internal compartment in which the bulk material is held. An elaborate conveyor system erected and suspended outside of the silo carries the bulk material to the top of the silo. The conveyor system then directs the bulk material into the compartment of the silo through an opening formed on the top of the silo.

A dust collector is also typically mounted on the top of the silo in communication with the internal compartment. To service and inspect both the dust collector and the conveyor system, it is necessary to provide access to the top of the silo. The access is typically provided by some form of stair assembly mounted on the exterior of the silo. In one example, a stair tower is erected spaced apart from the silo. A walk-through truss is then suspended from the stair tower to the top of the silo. In other embodiments, caged ladders and stairs are mounted directly on the exterior surface of the silo.

In order to dispense the bulk material from the compartment of the silo, an outlet is usually centrally formed on the floor of the silo. When the storage chamber is full and the outlet is open, the bulk material freely flows through the outlet under the force of gravity. As the storage chamber empties, reclaimers, such as augers, disposed within the compartment of the silo are used to drag the bulk material from around the sides of the compartment to the central outlet.

Although conventional storage facilities are well established and serve their intended purpose, they have a number of shortcomings. For example, as discussed above, the conveyor systems that feed the bulk material to the top of the silo and the stair assemblies that provide access to the top of the silos are erected and/or suspended on the exterior of the silo. Construction of these exterior structures requires the extensive use of cranes. Furthermore, the builders must often operate in dangerously exposed locations to erect such structures. As a result, conventional external conveyor and stair systems are expensive, time consuming, and often dangerous to erect.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
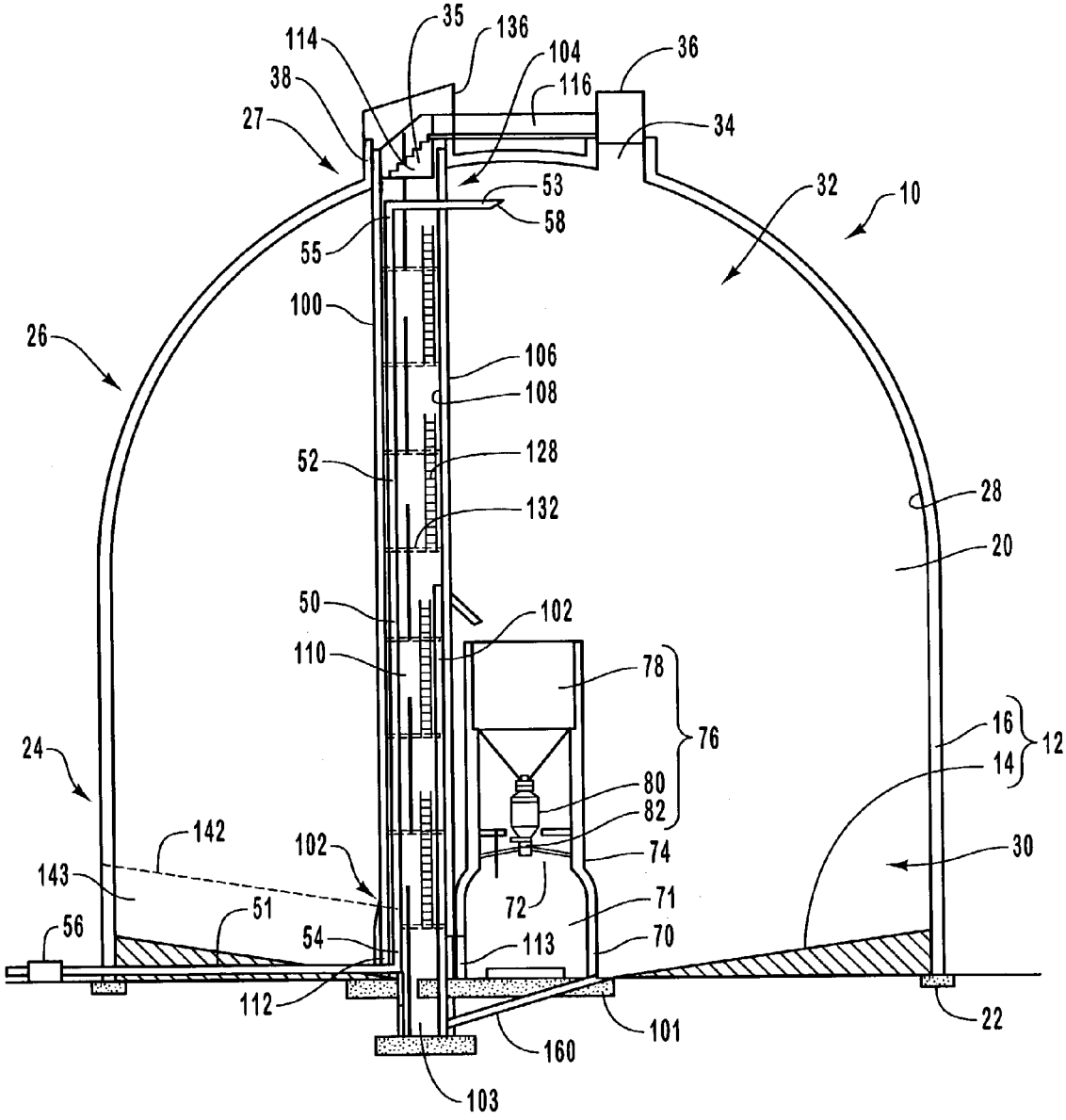
FIG. 1 is an elevated cross-sectional side view of a bulk material storage facility according to one embodiment of the present invention.

The present invention relates to storage facilities configured to store bulk materials. As used in the specification and appended claims, the term "bulk material" is intended to include grains, legumes, salt, cement, and other granulated or powdered flowable food and non-food materials. Depicted in FIG. 1 is one embodiment of a storage facility 10 incorporating features of the present invention. Storage facility 10 comprises a storage structure 12. Storage structure 12 includes a floor 14 and a dome-shaped boundary wall 16 upstanding thereabout. Boundary wall 16 is erected on a foundation 22. Storage structure 12 can be erected using conventional techniques and materials or by other techniques such as disclosed in U.S. Pat. No. 4,324,074, which is incorporated herein by specific reference.

Boundary wall 16 generally has a lower end 24 and an elevated upper end 26 that terminates at a top end 27. Although boundary wall 16 is depicted as being domed-shaped, in alternative embodiments boundary wall 16 can be a variety of shapes and sizes. For example, boundary wall 16 can be square, rectangular, cylindrical, or any other desired shape.

Boundary wall 16 also has an interior surface 28. Interior surface 28 and floor 14 bound a chamber 20 configured to store bulk material. Chamber 20 generally comprises a lower region 30 and an elevated upper region 32. Because storage structure 12 may have a variety of transverse configurations such as, but not limited to, circular, square, oval, polygonal, and the like, boundary wall 16 can comprise a single continuous wall or a plurality of interconnected walls. Furthermore, in alternative embodiments, boundary wall 16 is not required to be enclosed. For example, boundary wall 16 can have an open top. Furthermore, while floor 14 and boundary wall 16 are formed on the ground and built upon foundation 22, they may, alternatively, be supported off the ground by posts or other supporting structures.

Formed on top end 27 of boundary wall 16 is a first opening 34 and a spaced apart second opening 35. Mounted on boundary wall 16 in communication with first opening 34 is a dust collector 36. Dust collector 36 collects dust from the bulk material as it is fed into chamber 20. A head house 136 is mounted on boundary wall 16 over second opening 35. A walkway 116 extends between head house 136 and dust collector 36 so as to provide access therebetween.

A tubular chase 100 is disposed and upwardly extends within chamber 20 generally between lower portion 30 and upper portion 32 thereof. Tubular chase 100 has an exterior surface 106 and an interior surface 108 each extending between a first end 102 and an opposing second end 104. The interior surface 108 of tubular chase 100 bounds a passageway 110.

First end 102 of tubular chase 100 is mounted on a foundation 101 disposed at or below floor 14. In one embodiment, an arched tunnel wall depicted by dashed lines 142 bounds a tunnel 143. Tunnel wall 142 passes through boundary wall 16, extends along floor 14, and couples with first end 102 of chase 100 at a first access 112 thereof. As such, tunnel 143 enables a person to access the lower end of chase 100 from outside of storage structure 12. In alternative embodiments, foundation 101 and chase 100 can extend below floor 14. In this embodiment, tunnel 143 can extend underground to communicate with chase 100. Other approaches for accessing first end 102 of chase 100 will be discussed below in greater detail.

As will also be discussed below in greater detail, second end 104 of tubular chase 100 is slidably disposed within second opening 35 of boundary wall 16 so as to form a slip-fit connection therebetween. This slip-fit connection allows for variations in settling, expansion and contraction between boundary wall 16 and chase 100. A second access 114 is formed at second end 104 of chase 100 so that an individual can pass from passageway 110 of chase 100 through second opening 35 of boundary wall 16 and into head housing 136. In turn, as previously discussed, head housing 136 is in communication with dust collector 36 through walkway 116. Accordingly, chase 100 enables selective access to dust collector 36 for inspection and servicing.

Tubular chase 100 has sufficient size to enable one or more persons to enter and pass through passageway 110 thereof. In one embodiment, the diameter of passageway 110 of tubular chase 100 is about 2 meters to about 5 meters. Other dimensions can also be used. In one embodiment of the present invention means are provided for enabling people to travel along passageway 110 of tubular chase 100 between first end 102 and opposing second end 104. In the embodiment of FIG. 1, such means comprises a ladder system 128 which allows a person to ascend or descend within passageway 110 of tubular chase 100. Landings 132 may be installed at various elevations as appropriate. In alternative embodiments (not shown) such means can comprise elevators, man-lifts, stairs, ramps, combinations thereof, and the like.

Tubular chase 100 can be made in a variety of different ways and configurations using a number of different materials. For example, tubular chase 100 can be made using conventional steel and poured concrete techniques or be formed of heavy duty prefabricated steel or other material pipes that are assembled together. Independent of the method, chase 100 can have a transverse cross section that is circular, square, rectangular, elliptical, triangular, or any other polygonal or irregular configuration. As a result, chase 100 can comprise a single continuous encircling wall or a plurality of interconnected circling walls. Generally, the shape of chase 100 will be maintained throughout the entire length thereof. However, the shape of chase 100 can vary along the length thereof.

Figure 2:
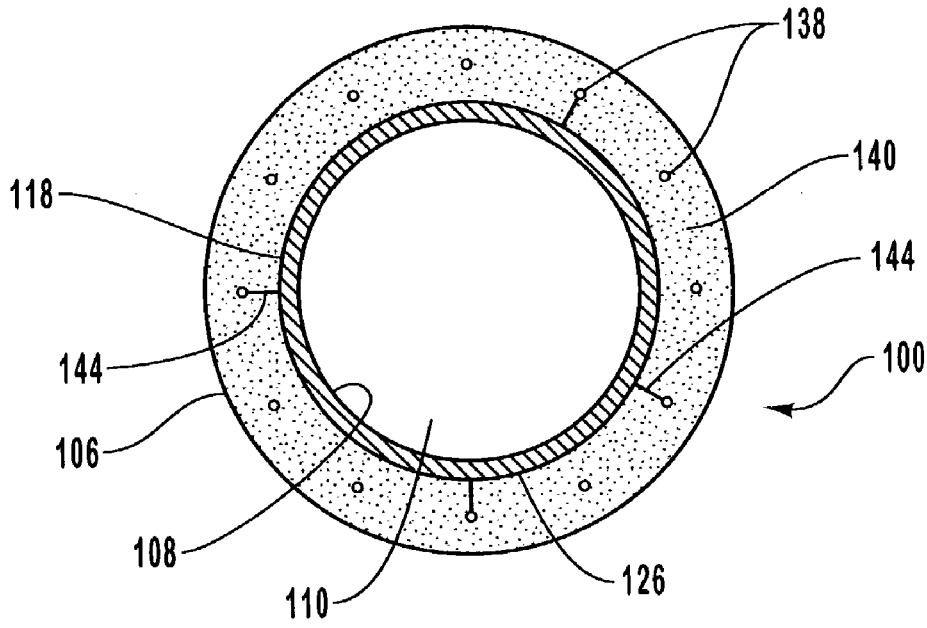
FIG. 2 is a cross sectional top view of the tubular chase of the storage facility shown in FIG. 1.

In the cross section depicted in FIG. 2, tubular chase 100 comprises a tubular form 118 having one or more support layers 140 applied thereto. Specifically, tubular form 118 comprises interior surface 108, which as previously discussed bounds passageway 110, and an opposing exterior surface 126. Although form 118 can comprise an integral continuous member, form 118 typically comprises a plurality of discrete tubular members that are connected together such as by welding, bolting, or the like. Form 118 is typically comprised of metal such as smooth steel or cold-formed steel. In one embodiment form 118 is comprised of corrugated galvanized steel pipe such as used in storm water culvert pipes. Form 118 can also be made of other materials or combinations thereof.

Once tubular form 118 is erected, a reinforcing mat 138 is secured adjacent to exterior surface 126 of form 118. Reinforcing mat 138 typically comprises interconnected strands of conventional rebar. In one embodiment, reinforcing mat 138 comprises horizontal and vertical spaced apart strands which may be interconnected using conventional tying methods. Reinforcing mat 138 may be secured to tubular form 118 using hangers 144 attached to form 118 such that reinforcing mat 138 is spaced apart a distance from tubular form 118. As a result, as will be discussed below in greater detail, reinforcing mat 138 may be embedded within support layer 140 applied thereon.

It is appreciated that depending on the size, configuration, and other engineering requirements of tubular chase 100, rebar of one or more different sizes can be used at different locations on tubular form 118. Furthermore, the rebar can be positioned at one or more different spaces at different locations on tubular form 118. For example, since the base of tubular form 118 carries more weight, the rebar is typically larger and/or closer together at the base of tubular form 118 than at the top thereof. In yet other embodiments, it is appreciated that reinforcing mat 138 need not be made of conventional rebar but can be made from other reinforcing materials such as metal cable, wire, mesh, and the like and combinations thereof.

Once reinforcing mat 138 has been positioned, a support layer 140 is formed so as to cover exterior surface 126 of tubular form 118 and reinforcing mat 138. In this regard, reinforcing mat 138 functions as reinforcing for support layer 140.

Additional support structures (not shown), such as reinforcing rods or rebar, may be embedded within and project from foundation 101 (FIG. 1) to which tubular form 118 is secured. Such reinforcing structures may be connected to reinforcing mat 138. As support layer 140 is built-up adjacent foundation 101, support layer 140 will also cover the reinforcing structures projecting from foundation 101, thereby fixing support layer 140 to foundation 101.

Support layer 140 is typically comprised of a cementitious material. As used in the specification and appended claims, the term "cementitious material" is intended to include any material that includes cement. Cementitious materials typically include graded sand and/or any number of conventional additives such as fillers, fibers, hardeners, chemical additives or others with function to improve properties relating to strength, finishing, spraying, curing, and the like. In one embodiment, the cementitious material comprises sprayable, commercially available cementitious material such as "Gunite" or "Shotcrete".

For efficiency, it is desirable that the material for support layer 140 be sprayable. For example, the cementitious material can be applied through a hose at high velocity which results in dense material having a cured compressive strength in a range between about 3,000 psi to about 10,000 psi. Alternatively, support layer 140 can be applied by hand, such as by use of a trowel, or other techniques.

Although not required, in one embodiment to help ensure that support layer 140 initially secures to exterior surface 126 of form 118 as support layer 140 is initially applied thereto, a bonding agent is applied in a layer over exterior surface 126 of form 118. In one embodiment the bonding agent comprises an acrylic latex bonding agent such as V-COAT available from Diamond Vogel Paint out of Orange City, Iowa. In other embodiments the bonding agent can simply comprise a rewettable bonding agent that has adhesive properties when hydrated so as to help stick support layer 140 to form 118.

In one embodiment support layer 140 has a thickness of about 15 cm to about 30 cm. The thickness of support layer 140 will depend on the design requirement of tubular chase 100. Some criteria which will be factored in include the loads that tubular chase 100 will experience with additional structural features secured thereon (e.g., stairs, elevators, platforms, pipes, and the like), movement tubular chase 100 will experience due to filling and emptying of chamber 20, and any movement due to geotechnical and atmospheric factors.

It is appreciated that two or more support layers 140 may be formed on tubular form 118. Separate reinforcing mats 138 can be embedded between or within the various support layers 140. Reinforcing mat 138 in an inner support layer 140 may be used to secure subsequent reinforcing mats 138 by using conventional ties as will be understood in the art. It is appreciated that the type of reinforcing mat 138 may differ between different support layers 140. Furthermore, the type of reinforcing mat 138 and number of support layers 140 will vary depending on the engineering requirements of tubular chase 100.

Prior to applying the one or more support layers 140, frames can be mounted on form 118 so as to outline the accesses or other openings to be formed through chase 100. Reinforcing mat 138 and support layers 140 are then applied over form 118 and up to the frames but not on the area over which the accesses or openings are to be formed. After the one or more support layers 140 are cured, the exposed area of form 118 bounded by the frames can be cut out so as to produce the accesses or openings. If desired, a protective coating can be applied over exterior surface 106 of tubular chase 100 to protect it from moisture and other effects; otherwise, it can be left exposed.

Figure 3:
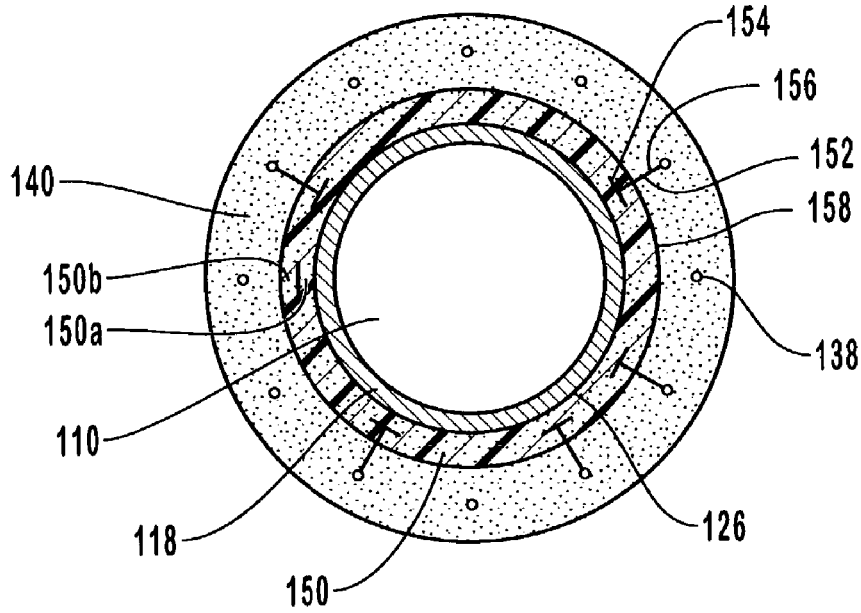
FIG. 3 is a cross sectional top view of an alternative embodiment of the tubular chase shown in FIG. 2.

In an alternative embodiment depicted in FIG. 3, prior to the application of support layer 140, a base layer 150 is applied to exterior surface 126 of form 118. Base layer 150 is generally comprised of a polymeric foam. As used in the specification and appended claims, the term "polymeric foam" is intended to include all polymeric materials that have been expanded in some way so as to form a foam. Examples of polymeric foams include polyurethane foam, Styrofoam, and other conventional expandable polymeric foams. The polymeric foam can also comprise additives such as fillers, fibers, or other additives which affect properties such as strength, expansion, setting, finish, and the like. The polymeric foam can be applied through conventional spraying techniques or other conventional processes. Likewise, the polymeric foam can be applied in prefabricated sections. One common example of a polymeric foam used in the manufacture of base layer 150 is 1½ lb/ft$^3$ to 2 lb/ft$^3$ polyurethane foam which is sprayed onto form 118. In other embodiments, it is also appreciated that non-polymeric materials, such as cementitious materials, adhesives, or any other types of materials that can be applied and then set, can also be used for base layer 150.

Base layer 150 can be formed as a single layer from a single application or multiple overlapping sub-layers of the same or different materials. For example, base layer 150 comprises a first base sub-layer 150*a* and a second base sub-layer 150*b*. First base sub-layer 150*a* and second base sub-layer 150*b* combine to form a single, substantially inseparable base layer 150.

Base layer 150 is applied to exterior surface 126 of form 118 by initially spraying first base sub-layer 150*a* having a thickness in a range between about 1 cm to about 5 cm with about 1 cm to about 3 cm being more common. A plurality of spaced apart hangers 152 are then mounted on sub-layer 150*a*.

In one embodiment each hanger 152 comprises a planar base plate 154 having an elongated hanger rod 156 projecting therefrom. Once hangers 152 are secured to first base sub-layer 150*a*, a second base sub-layer 150*b* is sprayed over base sub-layer 150*a* so as to embed base plate 154 of hangers 152 therebetween. The now complete base layer 150 typically has a thickness in a range between about 5 cm to about 15 cm. It is appreciated that first base sub-layer 150*a* and second base sub-layer 150*b* may have the same thickness or have different thicknesses. Additionally, it will be appreciated that first base sub-layer 150*a* and second base sub-layer 150*b* may be comprised of the same material or different material. Other combinations may also be employed depending on the engineering design and construction needs of chase 100.

Each hanger rod 156 of hangers 152 has a predetermined length. As such, during the application of second base sub-layer 150*b*, the operator is able to visually observe the depth of base sub-layer 150*b* being applied through observing the build-up depth along the length of hanger rods 156. Additionally, the relatively thin hanger rods 156 enable a uniform spraying of polymeric foam about hanger rods 156 without impairing uniformity of density or layer thickness of the foam. Hanger rods 156 are made long enough to extend outwardly from the completed base layer 150 a distance in a range between about 8 cm to about 15 cm, although other dimensions can also be used. It is also appreciated that markings can be formed along the length of hanger rods 156 so as to assist in forming base sub-layer 150*b* to a desired depth.

As a result of base plate 154 of hangers 152 being at least partially embedded within base layer 150, reinforcing mat 138, as discussed above, can now be secured to hangers 152 without pulling hangers 152 off of base layer 150. It is also appreciated that in other embodiments base plate 154 of hangers 152 can be secured directly to an exterior surface 158 of base layer 150 so that base plate 154 need not be embedded within base layer 150. Alternatively, hangers 94 or alternative designs thereof can be directly secured to exterior surface 126 of form 118, as discussed above with regard to FIG. 2, such as by welding, bolting, or the like. Once the reinforcing mat 138 is secured, the one or more support layers 140 can be applied as also discussed above.

Tubular chase 100 can be engineered to provide support for other mechanical structures that may be desirable in a storage facility. Such structures can include filling and dispensing structures, such as, but not limited to, conveyors, augers and piping, and other structural features such as electrical runs. Some of these structures may be secured to tubular form 118 after the tubular form is secured to foundation 101. In addition, structures for the means for enabling people to travel along passageway 110 of tubular chase 100 (e.g., ladders, stairs, etc.) may be secured to tubular form 118 once it is secured to foundation 101.

Chase 100 has a number of unique benefit over conventional external access systems in that it easier and less expensive to erect and maintain.

As previously mentioned, second end 104 of tubular chase 100 is coupled with opening 35 of boundary wall 16 in a slip-fit connection. In the embodiment depicted in FIG. 4, a tubular conduit 134 is secured to a second end of tubular form 118. Tubular conduit 134 may be constructed of the same material as tubular form 118. Alternatively, tubular conduit 134 may be constructed of a thicker or higher strength material than tubular form 118. Tubular conduit 134 may be secured to tubular form 118 by various means known in the art such as, but not limited to, welding, bolting, adhesive, cementing, and the like. In yet another embodiment, tubular conduit 134 may be integrally formed with tubular form 118.

During assembly, the upper end of conduit 134 is slidably received within opening 35 of boundary wall 16 wile the lower end of conduit 134 is secured to form 118 as discussed above. That is, tubular conduit 134 is disposed in opening 35, but not rigidly secured thereto. It is appreciated, however, that tying structures (not shown) may be disposed between tubular conduit 134 and opening 35 to ensure that tubular conduit 134 is at least somewhat secured to boundary wall 16 so long as movement is allowed between tubular conduit 134 and opening 35. Opening 35 is bounded by a cylindrical reinforcing wall 38. Cylindrical wall 38 may be constructed of the same material as boundary wall 16. Alternatively, cylindrical wall 38 may be constructed of a different material but secured to boundary wall 16. The diameter of opening 35 is slightly larger than the diameter of tubular conduit 134. The small clearance between opening 35 and tubular conduit 134 allows for tolerance for movements between tubular chase 100 and boundary wall 16.

In one embodiment once conduit 134 and form 118 are secured together, reinforcing mat 138 and support layer(s) 140 are integrally applied over form 118 and the lower end of conduit 134, thereby further securing conduit 134 and form 118 together. Alternatively, conduit 134 can be dropped down through opening 35 after support layer(s) 140 are applied to form 118. In this embodiment, conduit 134 is secured by bolting or the like to the combined form 118, reinforcing mat 138, and support layer(s) 140.

The slip-fit connection formed between chase 100 and boundary wall 16 enables movement between boundary wall 16 and tubular chase 100. That is, boundary wall 16 and tubular chase 100 will be subject to different temperature induced movements from the atmosphere and also from within storage facility 10. Furthermore, boundary wall 16 and tubular chase 100 will experience different settlement characteristics with respect to their respective foundations 22, 101. In addition, when chamber 20 is filled with bulk material, additional load interactions occur between boundary wall 16, tubular chase 100, and their respective foundations 22, 101. Differential movements from several inches to several feet are common in the structure of dome-shaped storage facilities. Normally, tubular chase 100 and foundation 101 will move downward to a greater degree than boundary wall 16 and foundation 22.

Figure 4:
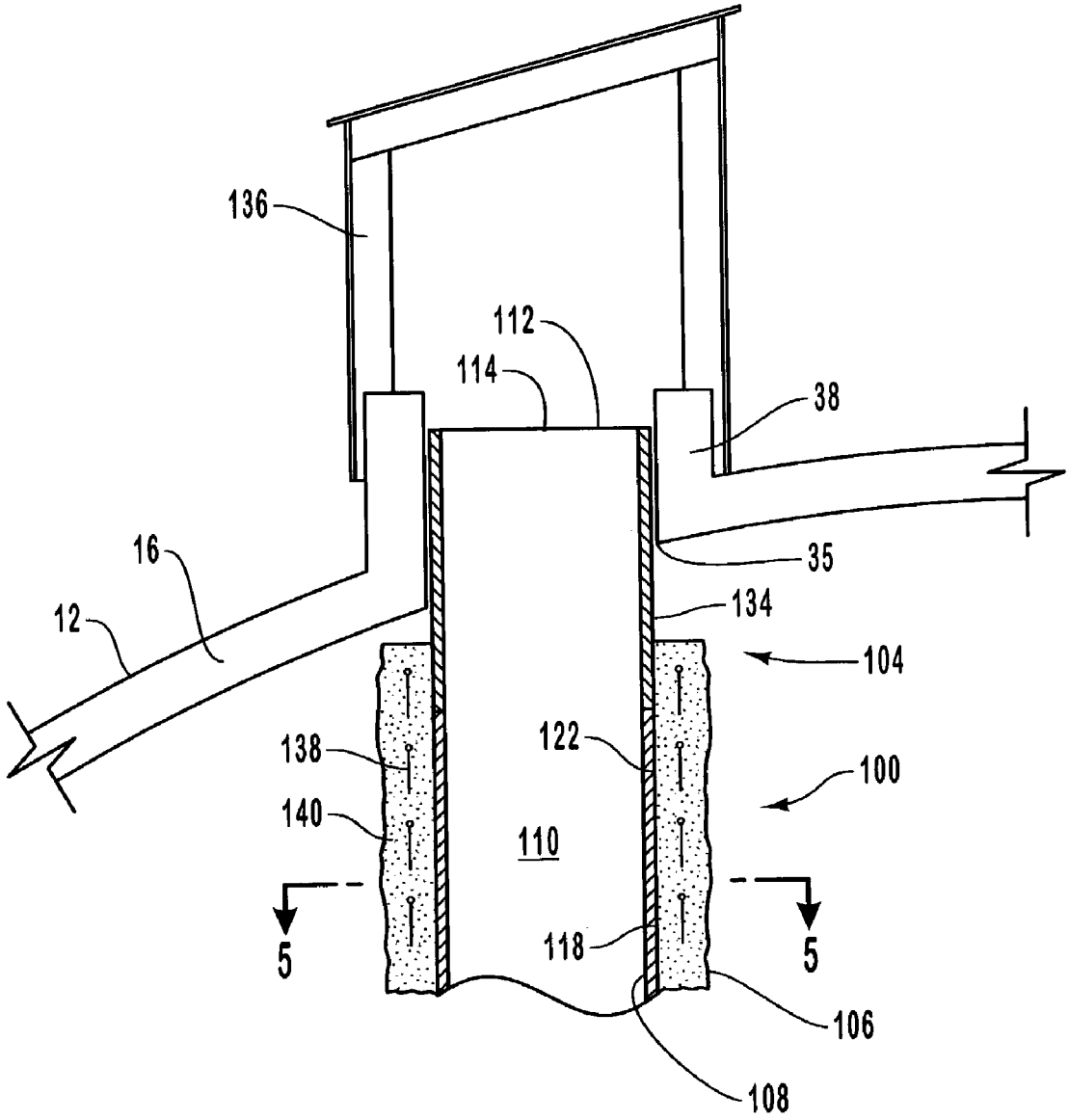
FIG. 4 is an enlarged cross-sectional side view of the chase in FIG. 1 being coupled in a slip-fit connection with the boundary wall.

The slip-fit connection depicted in FIG. 4 is exemplary of the types of configurations that may be used to counteract the differential movements in tubular chase 100 and boundary wall 16. It appreciated that other conventional slip joint configurations can also be used.

In one embodiment of the present invention means are also provided for conveying bulk material inside of chamber 20 from lower portion 30 to upper portion 32 of chamber 20 so as to enable selective filling of chamber 20 with bulk material from upper portion 32. The following will discuss exemplary structures providing these means which may be employed in the storage facilities of the present invention but which are not required. Furthermore, it is appreciated that the present invention is not limited to these particular structures.

Returning to FIG. 1, a transfer pipe 50 travels from outside of storage structure 12 into chamber 20. Transfer pipe 50 includes a base section 51, a raised section 52, and an outlet section 53. Base section 51 horizontally extends through boundary wall 22, along floor 14 and into first end 102 of tubular chase 100. Raised section 52 of transfer pipe 50 is vertically disposed within and is supported by chase 100. Raised section 52 includes a first end 54 coupled with base section 51 at a right elbow and a second end 55 disposed in upper portion 32 of chamber 20. Outlet section 53 of transfer pipe 50 couples with second end 55 of raised section 52 at a right elbow and horizontally extends out of chase 100 where it terminates at a freely exposed outlet port 58. Outlet port 58 is thus disposed in upper portion 32 of chamber 20. Transfer pipe 50 may be secured to tubular chase 100 by any means known in the art such as welding, bolting, brackets, and the like. Thus, outlet port 58 of transfer pipe 50 is positioned in upper portion 32 of chamber 20 so that bulk material may be selectively conveyed therethrough to fill chamber 20.

The means for conveying bulk material inside of chamber 20 from lower portion 30 to upper portion 32 of chamber 20 further includes means coupled to transfer pipe 50 for selectively conveying bulk material upwardly within raised section 52 of transfer pipe 50 and exiting outlet port 58. By way of example and not by limitation, such means includes a pump 56 coupled with transfer pipe 50 outside of storage structure 12. Pump 56 fluidizes the bulk material and conveys it through transfer pipe 50 and out outlet port 58 where it falls to fill chamber 20. Pump 56 is broadly intended to include pumps, blowers, and other conventional apparatus known in the art for fluidizing and conveying bulk material within a pipe. The type and size of pump 56 is in part dependent on the type and quantity of bulk material to be conveyed.

Figure 5:
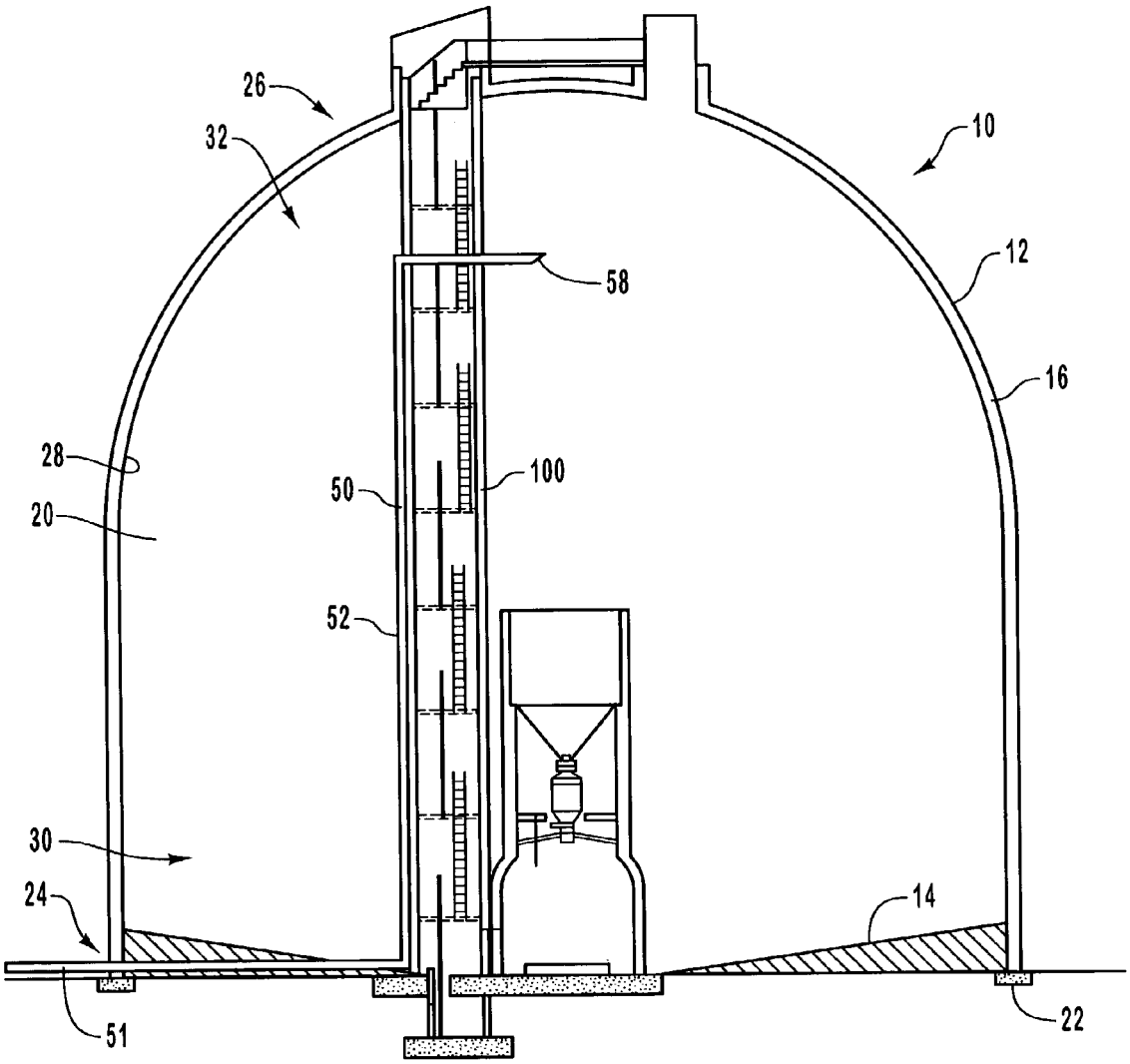
FIG. 5 is an elevated cross-sectional side view of an alternative bulk material storage facility.

The embodiment of FIG. 1 illustrates raised section 52 of transfer pipe 50 being contained within tubular chase 100. It is appreciated, however, that some or all of raised section 52 can be disposed outside of tubular chase 100. For example, in FIG. 5, raised section 52 of transfer pipe 50 is secured on the exterior of chase 100. In other embodiments, transfer pipe 50 can be spaced apart from chase 100 and secured by other supports such as poles, cables, and/or other types of braces independent of chase 100.

Accordingly, by using transfer pipe 50 in conjunction with pump 56, chamber 20 can be filled with bulk material by traveling through the interior of chamber 20. The assembly and operation of internal transfer pipe 50 is substantially easier and less expensive than conventional external conveyor systems or other external delivery systems.

In one embodiment of the present invention means are also provided for dispensing the bulk material from within chamber 20 after chamber 20 has been at least partially filled with bulk material. The following will discuss exemplary structures providing these means which may be employed in the storage facilities of the present invention. It will be appreciated that the present invention is not limited to these particular structures.

In the embodiment of FIG. 1, a tunnel wall 70 bounds a tunnel 71 that extends through storage structure 12. Tunnel 71 enables a transport vehicle (not shown), such as a truck, to enter tunnel 71 from one side of storage structure 12 and exit from the opposing side thereof. A dispensing aperture 72 is formed through the top of tunnel wall 70 centrally within chamber 20. A wall 74 upwardly extends from tunnel wall 70 so as to encircle dispensing aperture 72. A hopper assembly 76 is disposed within the area bounded by wall 74. Hopper assembly 76 comprises a bin 78, a dust collector 80, and a loading spout 82. Bin 78 is secured to wall 74 such that bulk material is not able to leak between bin 78 and wall 74.

Bin 78 and wall 74 can be made of concrete, steel, and/or any other materials having the desired strength and wear properties.

Thus, when chamber 20 is filled with bulk material above hopper assembly 76, the bulk material above hopper assembly 76 freely flows under gravitational force into bin 78. Aperture 72 communicates with tunnel 71 so that the transport vehicle can be moved directly underneath loading spout 36. Selective operation of loading spout 36 thus enables selective filling of the transport vehicle using the potential energy of the bulk material.

Because hopper assembly 76 is positioned well above floor 14 of storage structure 12, additional systems are required to fully empty chamber 20. By way of example and not by limitation, a collector sink 103 is formed below foundation 101 in alignment with tubular chase 100. Floor 14 slopes radially inward toward sink 103. Furthermore, floor 14 is designed to be porous such that air or other gases can be dispensed up through floor 14 causing the bulk material resting thereon to fluidize and flow radially inward along floor 14 toward sink 103. Various channels 160 are formed through floor 14, foundation 101 and/or chase 100 so as to allow the fluidized bulk material to flow from floor 14 into sink 103.

A transport system 162 is disposed within passageway 110 and extends from sink 103 to a location just above bin 78. Transport system can comprise a vertical auger, bucket conveyors, bucket elevator, a fluidizing transport pipe, or any other conventional systems known in the art. Transport system 162 thus conveys the bulk material within sink 103 to above bin 78 where the bulk material is released so as to fall into bin 78, thereby allowing for subsequent dispensing of the bulk material.

It is appreciated that the above dispensing assembly can have a variety of different modifications. For example, tunnel wall 70 and tunnel 71 need not extend all the way through storage structure 12 but rather can radially extend from hopper assembly 76 to the exterior of storage structure 12. Furthermore, tunnel 71 can be adapted to receive a convey belt system, train, or any other type of transport vehicle. In yet another embodiment, hopper assembly 76 and/or tunnel 71 can be formed partially or completely under ground so as to maximize the volume of chamber 20 and the amount of bulk material that can freely flow into hopper assembly 76. It is also noted that rather than forming tunnel wall 142 (FIG. 1) so as to provide access to chase 100, an access 113 can be formed directly between chase 100 and tunnel 71.

Figure 6:
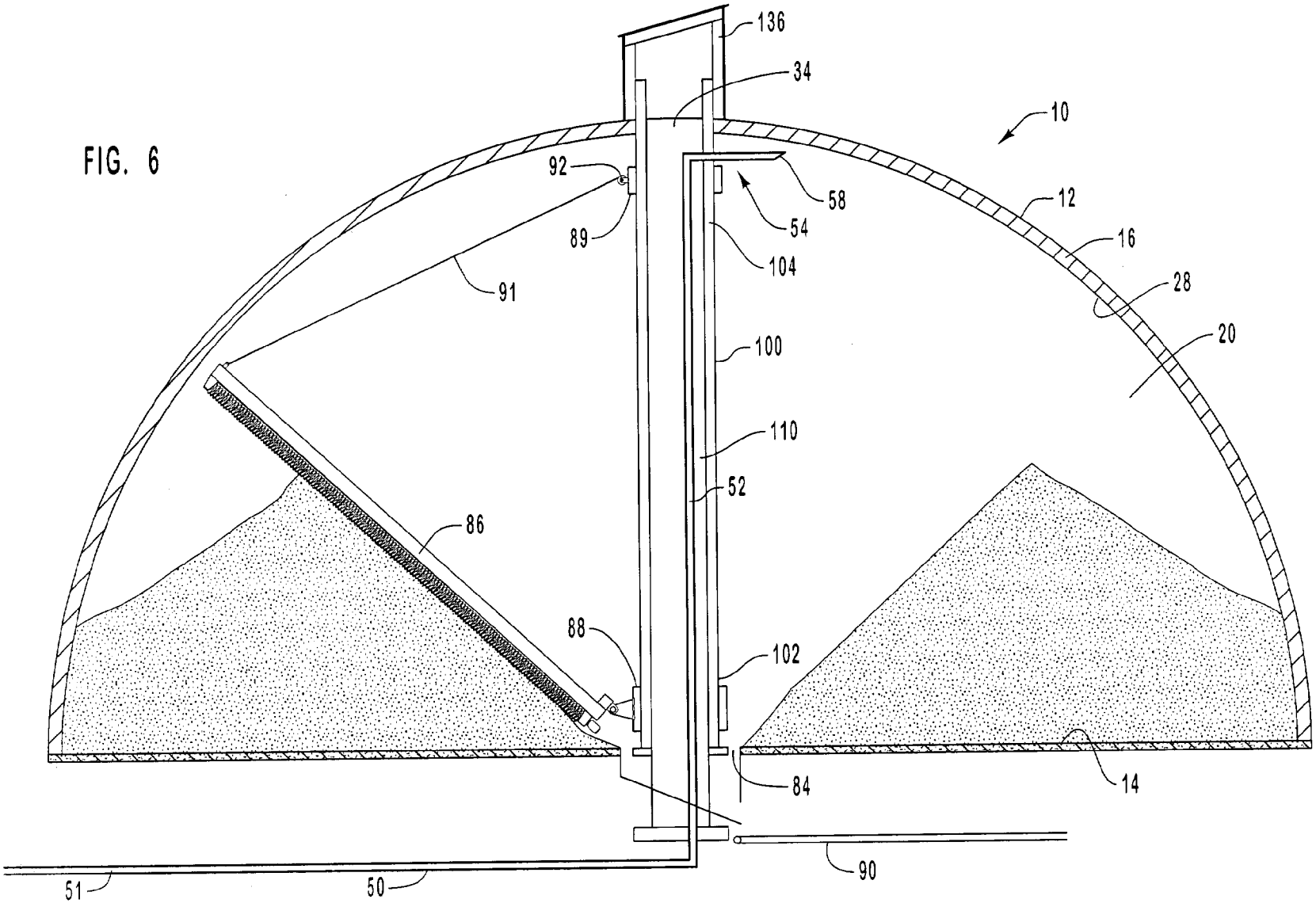
FIG. 6 is an elevated cross-sectional side view of another alternative of a bulk material storage facility.
Figure 1:
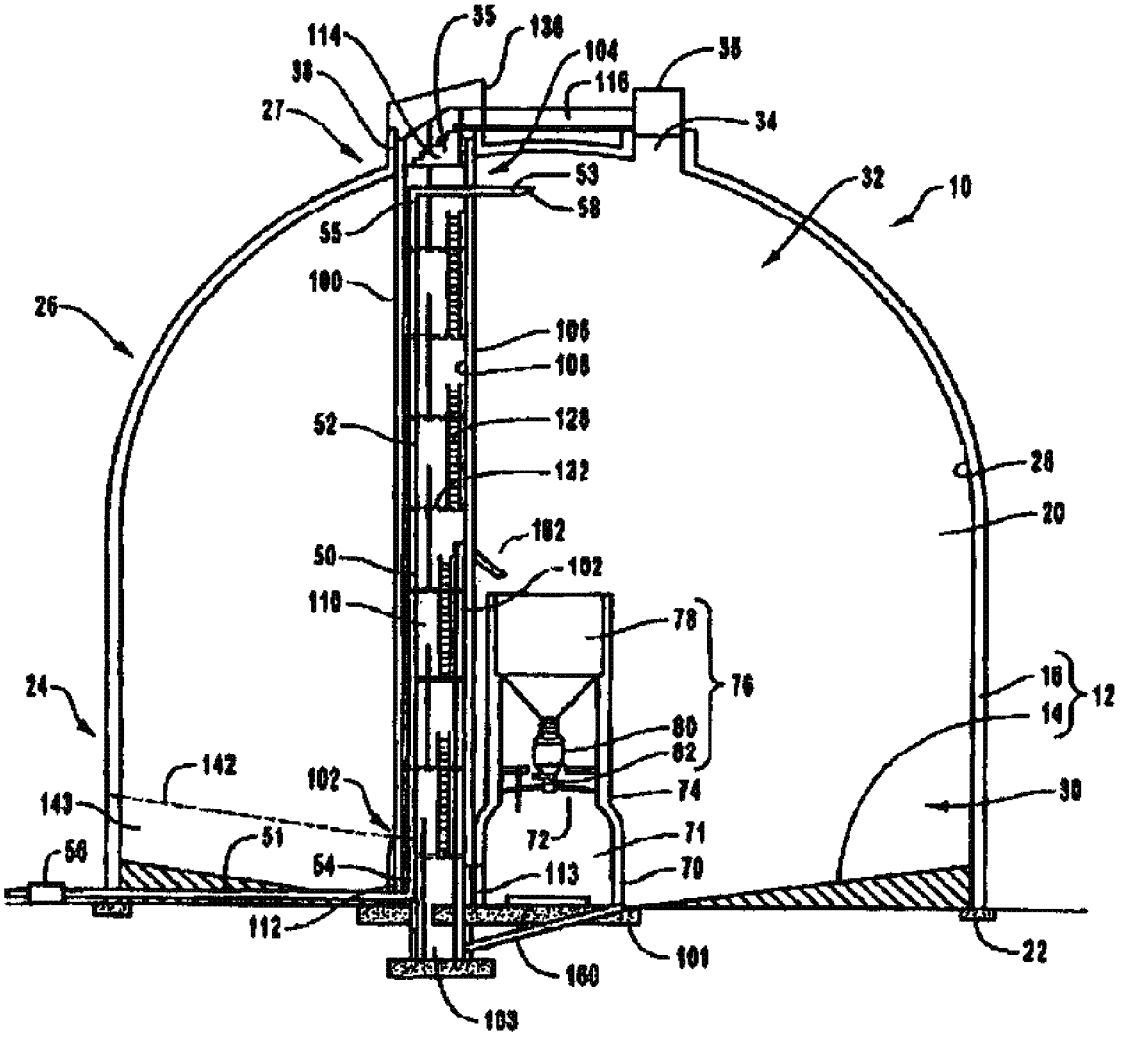

Depicted in FIG. 6 is an alternative structure for providing means for dispensing the bulk material from within chamber 20 after chamber 20 has been at least partially filled with bulk material. In the embodiment of FIG. 6, tubular chase 100 is positioned substantially centrally in chamber 20. A dispensing outlet 84 is formed concentrically around first end 102 of tubular chase 100. Tubular chase 100 provides support for an auger 86 which is configured to convey bulk material from the outer edges of chamber 20 inward toward dispensing outlet 84.

Specifically, a first collar 88 is rotatably mounted to the first end 102 of chase 100 while a second collar 89 is rotatably mounted to second end 104 of chase 100. Collars 88 and 89 are mechanically rotated by drive systems well known in the art. A first end of auger 86 is hinged mounted first collar 88 while a cable 91 extends from a winch 92 on second collar 89 to a second end of auger 86. When needed, auger 86 is thus able to rotate about tubular chase 100 and draw the bulk material to outlet 84. It is noted that since transfer pipe 50 is located within tubular chase 100, transfer pipe 50 does not interfere with the operation of auger 86. After the bulk material is dispensed through dispensing outlet 84, a conveyor belt 90 transports bulk material away from storage facility 10. An underground tunnel can be used to access first end 102 of chase 100 such that passageway 110 thereof can be used to access head house 136 and the related dust collector.

In other alternatives, auger 86 can be replaced with bucket or scoop conveyors. Furthermore, it is appreciated that auger 86 or the alternatives thereto can be operated in a variety of different configurations. Another alternative configuration for a dispensing assembly that can be mounted on chase 100 is disclosed in U.S. Pat. No. 6,203,261 B1, which is incorporated herein by specific reference.

The present invention may be embodied in other specific forms without departing from its spirit or essential characteristics. The described embodiments are to be considered in all respects only as illustrative and not restrictive. For example various features of the different embodiments can be mixed and matched. Furthermore, it is appreciated that the internal chase and transport system do not need to be used together. For example, in some embodiments the intern chase can be used with a conventional external conveyor system which loads the bulk material from outside. Likewise, the internal transport system can be used with a storage structure having an external stair system to access the dust collector.

The scope of the invention is, therefore, indicated by the appended claims rather than by the foregoing description. All changes which come within the meaning and range of equivalency of the claims are to be embraced within their scope.

What is claimed is:

1. A bulk material storage facility comprising:

a storage structure comprising a floor and a boundary wall upwardly extending therefrom, the boundary wall having a lower end and an upper end, the floor and boundary wall bounding a chamber adapted to receive bulk material;

a tubular chase at least partially disposed and upwardly extending within the chamber of the storage structure, the tubular chase having an interior surface bounding a passageway extending between a first end and an opposing second end, the first end of the tubular chase having a first access formed thereat, the second end of the tubular chase being coupled with the upper end of the boundary wall by a slip-fit connection and having a second access formed thereat; and means for enabling people to travel along the passageway of the tubular chase between the first access and the second access.

2. A bulk material storage facility as recited in claim 1, further comprising:

the chamber of the storage structure comprising a lower portion and an elevated upper portion; and means for conveying bulk material inside of the chamber from the lower portion of the chamber to the upper portion of the chamber so as to enable selective filling of the chamber with the bulk material from the upper portion of the chamber.

3. A bulk material storage facility as recited in claim 2, further comprising means for dispensing the bulk material from within the chamber.

4. A bulk material storage facility as recited in claim 2, wherein the means for conveying bulk material inside of the chamber from the lower portion of the chamber to the upper portion of the chamber so as to enable selective filling of the chamber with the bulk material from the upper portion of the chamber comprises:

a transfer pipe comprising a raised section extending from the lower portion of the chamber to the upper portion of the chamber, the transfer pipe terminating at an outlet port in the upper portion of the chamber; and means coupled with the transfer pipe for selectively conveying bulk material upwardly within the raised section of the transfer pipe and out the outlet port.

5. A bulk material storage facility as recited in claim 4, wherein the raised section of the transfer pipe is at least partially disposed within the passageway of the tubular chase.

6. A bulk material storage facility as recited in claim 4, wherein the means for selectively conveying bulk material upwardly within the raised section of the transfer pipe comprises a pump coupled with the transfer pipe.

7. A bulk material storage facility as recited in claim 3, wherein the means for dispensing the bulk material from within the chamber comprises:

a tunnel wall bounding a tunnel extending through or below the storage structure, the tunnel being adapted to receive a transport vehicle;

a bin disposed within the chamber of the storage structure; and an opening formed in the tunnel wall so as to provide communication between the bin and the tunnel.

8. A bulk material storage facility as recited in claim 3, wherein the means for dispensing the bulk material from within the chamber comprises an auger.

9. A bulk material storage facility as recited in claim 2, wherein the storage structure is dome-shaped.

10. A bulk material storage facility as recited in claim 1, further comprising a tunnel coupled with the first access of the chase and extending either within or below the chamber.

11. A bulk material storage facility as recited in claim 1, wherein the tubular chase further comprises:

a tubular form having an exterior surface and an interior surface, the interior surface of the tubular form bounding the passageway;

at least one support layer disposed on the exterior surface of the tubular form, the at least one support layer being comprised of a cementitious material; and a reinforcing mat disposed within the at least one support layer.

12. A bulk material storage facility as recited in claim 11, further comprising a base layer disposed between the tubular form and the support layer, the base layer being comprised of a polymeric foam.

13. A bulk material storage facility as recited in claim 11, further comprising a tubular conduit having a first end and opposing second end, the first end of the tubular conduit being attached to the tubular form, the second end of the tubular conduit being coupled with the boundary wall by the slip-fit connection.

14. A bulk material storage facility as recited in claim 1, wherein the boundary wall has a dome-shaped configuration.

15. A bulk material storage facility as recited in claim 1, wherein a portion of a transfer pipe is disposed within the passageway of the chase, the transfer pipe being configured so that bulk material passes therethrough.

16. A bulk material storage facility as recited in claim 1, wherein the boundary wall of the storage structure comprises a ceiling and a sidewall that encircles the chamber and extends between the floor and the ceiling, the tubular chase extending between the floor and the ceiling at a location within the chamber that is spaced apart from the sidewall.

17. A bulk material storage facility as recited in claim 1, wherein the means for enabling people to travel along the passageway of the tubular chase comprises at least one ladder disposed within the passageway to the chase.

18. A tubular chase disposed in a storage structure, the storage structure comprising a floor and a boundary wall upwardly extending therefrom, the floor and boundary wall bounding a chamber having a lower portion and an elevated upper portion, the tubular chase being configured to provide access between the lower portion and the elevated upper portion of the chamber of the storage structure, the tubular chase comprising:

a tubular form having an exterior surface and an interior surface, the interior surface of the tubular form bounding a passageway extending between a first end and an opposing second end, the first end of the tubular form being secured to a foundation and having a first access formed thereat;

a tubular conduit attached to the second end of the tubular form, the tubular conduit being coupled to the boundary wall by a slip-fit connection at the elevated upper portion of the chamber and having a second access formed thereat; and at least one support layer disposed on at least a portion of the exterior surface of the tubular form, the at least one support layer being comprised of a cementitious material.

19. A tubular chase as recited in claim 18, further comprising reinforcing mat disposed in the at least one support layer.

20. A tubular chase as recited in claim 18, wherein the tubular form and the tubular conduit are integrally formed.

21. A tubular chase as recited in claim 20, wherein the at least one support layer is disposed on at least a portion of the exterior surface of the tubular conduit.

22. A tubular chase as recited in claims 18, further comprising means for enabling people to travel along the passageway of the tubular chase between the first access and the second access.

23. A bulk material storage facility as recited in claim 22, wherein the means for enabling people to travel along the passageway of the tubular chase comprises at least one ladder disposed within the passageway of the tubular chase.

24. A method for forming a tubular chase within a storage structure, the storage structure comprising a floor and a boundary wall upwardly extending therefrom, the floor and boundary wall bounding a chamber having a lower portion and an elevated upper portion, the tubular chase being configured to provide access between the lower portion and the elevated upper portion of the chamber of the storage structure, the method comprising:

erecting a tubular form on a foundation such that the tubular form extends between the lower portion and the elevated upper portion of the chamber;

coupling an end of the tubular form by a slip-fit connection to the boundary wall of the storage structure at the elevated upper portion of the chamber; and applying a cementitious support layer over at least a portion of an exterior surface of the tubular form.

25. The method as recited in claim 24, wherein coupling the tubular form to the boundary wall of the storage structure at the elevated upper portion of the chamber further comprises:

joining a first end of a tubular conduit to the second end of the tubular form; and disposing a second end of the tubular conduit within an aperture formed in the boundary wall at the upper portion of the chamber.

26. The method as recited in claim 25, further comprising applying a cementitious support layer over at least a portion of an exterior surface of the tubular conduit.

27. The method as recited in claim 26, further comprising, before applying a cementitious support layer over at least a portion of an exterior surface of the tubular form, securing a reinforcing mat on the exterior surface of the tubular form.

* * * * *

UNITED STATES PATENT AND TRADEMARK OFFICE

CERTIFICATE OF CORRECTION

PATENT NO. : 7,127,854 B2
APPLICATION NO. : 10/366495
DATED : October 31, 2006
INVENTOR(S) : Thomas W. Hedrick It is certified that error appears in the above-identified patent and that said Letters Patent is hereby corrected as shown below:

Title Page, illustrating a Figure should be deleted, and replaced with new Title Page illustrating a Figure. (attached)

Delete Drawing Sheet 1 of 5 and replace with Drawing Sheet 1 of 5. (attached)

Column 4
Line 36, before "foundation" insert --to--

Column 6
Line 41, change "94" to --152--
Line 58, change "benefit" to --benefits--
Line 59, change "it easier" to --it is easier--

Column 7
Line 8, change "wile" to --while--

Column 8
Line 2, change "22" to --16--

Column 9
Line 9, change each instance of "36" to --82--
Line 46, change "an" to --and--

Signed and Sealed this

Seventh Day of April, 2009

John Doll

JOHN DOLL
*Acting Director of the United States Patent and Trademark Office*

(12) United States Patent
Hedrick

(10) Patent No.: US 7,127,854 B2
(45) Date of Patent: Oct. 31, 2006

(54) BULK MATERIAL STORAGE FACILITIES WITH ACCESS CHASES AND/OR INTERNAL FILLING STRUCTURES

(76) Inventor: Thomas W. Hedrick, 102 Larkspur, Sikeston, MO (US) 63801

( * ) Notice: Subject to any disclaimer, the term of this patent is extended or adjusted under 35 U.S.C. 154(b) by 221 days.

(21) Appl. No.: 10/366,495

(22) Filed: Feb. 13, 2003

(65) Prior Publication Data

US 2004/0159056 A1 Aug. 19, 2004

(51) Int. Cl.
*B65G 65/42* (2006.01)
*E04H 7/00* (2006.01)

(52) U.S. Cl. ..... 52/192; 52/195

(58) Field of Classification Search ..... 52/20, 52/21, 192, 195, 245, 309.12, 309.17, 197
See application file for complete search history.

(56) References Cited

U.S. PATENT DOCUMENTS

| | | | | | |
|---|---|---|---|---|---|
| 1,050,022 | A | * | 1/1913 | Hindmarsh | 52/182 |
| 1,050,953 | A | * | 1/1913 | Kint | 52/195 |
| 1,758,662 | A | * | 5/1930 | Heath | 52/197 |
| 2,500,043 | A | | 3/1950 | Radtke | |
| 2,801,137 | A | * | 7/1957 | Clay | 414/321 |
| 3,073,018 | A | * | 1/1963 | Gauthron | 52/247 |
| 3,363,785 | A | | 1/1968 | Kucera | |
| 3,513,995 | A | | 5/1970 | Stroker | |
| 3,526,328 | A | | 9/1970 | Garrett et al. | |
| 3,655,245 | A | | 4/1972 | Schumacher | |
| 3,847,289 | A | | 11/1974 | Fischer | |
| 3,953,629 | A | * | 4/1976 | Wesch | 428/324 |
| 3,968,998 | A | | 7/1976 | Wolf | |
| 3,977,541 | A | | 8/1976 | Watson | |
| 3,982,640 | A | | 9/1976 | Nauta | |
| 4,038,795 | A | * | 8/1977 | Abrams | 52/169.7 |
| 4,170,433 | A | | 10/1979 | Haahjem | |
| 4,324,074 | A | | 4/1982 | South et al. | |
| 4,373,623 | A | | 2/1983 | Bruecker | |
| 4,412,561 | A | * | 11/1983 | Sakaguchi et al. | 138/174 |
| 4,450,873 | A | * | 5/1984 | Sadler et al. | 138/174 |
| 4,462,744 | A | | 7/1984 | Rasilainen et al. | |
| 4,465,409 | A | | 8/1984 | Buschbom et al. | |
| 4,479,334 | A | * | 10/1984 | Goode | 52/197 |
| 4,616,969 | A | | 10/1986 | Haahjem | |
| 4,645,403 | A | | 2/1987 | DeWit | |
| 4,655,666 | A | | 4/1987 | Cantenot | |
| 4,721,425 | A | | 1/1988 | Stroker | |
| 4,773,808 | A | | 9/1988 | Fischer et al. | |
| 4,775,278 | A | | 10/1988 | Fischer et al. | |
| 4,806,058 | A | | 2/1989 | Galichowski et al. | |
| 4,885,880 | A | * | 12/1989 | Sudrabin et al. | 52/169.6 |
| 5,098,247 | A | | 3/1992 | Campbell | |
| 5,112,180 | A | | 5/1992 | Hough | |
| 5,180,272 | A | | 1/1993 | Campbell | |
| 5,241,797 | A | * | 9/1993 | Cliff | 52/192 |
| 5,449,263 | A | | 9/1995 | Campbell et al. | |
| 5,944,168 | A | | 8/1999 | Campbell et al. | |

(Continued)

*Primary Examiner*—Peter R. Brown
(74) *Attorney, Agent, or Firm*—Workman Nydegger

(57) ABSTRACT

A storage facility includes a storage structure having a floor and a boundary wall upwardly extending therefrom, the floor and boundary wall bounding a chamber adapted to receive bulk material. A tubular chase bounds a passageway and is at least partially disposed and upwardly extends within the chamber of the storage structure. A transfer pipe includes a raised section disposed and upwardly extending within the chamber. The transfer pipe terminates at an outlet port disposed in an upper portion of the chamber. A pump is coupled with the transfer pipe for conveying bulk material through the transfer pipe and into the chamber.

27 Claims, 5 Drawing Sheets

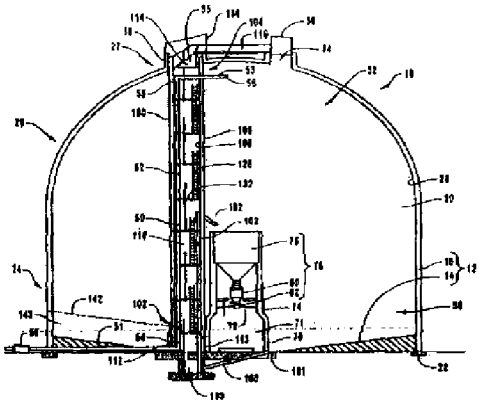

FIG. 1